US008216402B2

(12) United States Patent
Gaudre et al.

(10) Patent No.: US 8,216,402 B2
(45) Date of Patent: Jul. 10, 2012

(54) MANUFACTURE OF PYROTECHNIC OBJECTS BY A DRY PROCESS; PYROTECHNIC OBJECTS

(75) Inventors: Marie Gaudre, Le Haillan (FR); Eric Giraud, Bordeaux (FR); Dimitri Charrette, Saint Medard en Jalles (FX)

(73) Assignee: Herakles, Le Haillan (FR)

( * ) Notice: Subject to any disclaimer, the term of this patent is extended or adjusted under 35 U.S.C. 154(b) by 1023 days.

(21) Appl. No.: 11/922,194

(22) PCT Filed: Jun. 15, 2006

(86) PCT No.: PCT/FR2006/050606

§ 371 (c)(1),
(2), (4) Date: Jul. 21, 2008

(87) PCT Pub. No.: WO2006/134311

PCT Pub. Date: Dec. 21, 2006

(65) Prior Publication Data

US 2009/0205757 A1 Aug. 20, 2009

(30) Foreign Application Priority Data

Jun. 15, 2005 (FR) ..... 05 06102

(51) Int. Cl.
*D03D 23/00* (2006.01)
*C06B 45/00* (2006.01)
*C06B 31/00* (2006.01)

(52) U.S. Cl. ..... 149/109.6; 149/2; 149/45

(58) Field of Classification Search ..... 149/2, 45, 149/109.6

See application file for complete search history.

(56) References Cited

U.S. PATENT DOCUMENTS

| | | | | |
|---|---|---|---|---|
| 4,349,493 | A | 9/1982 | Casberg et al. | |
| 5,489,349 | A * | 2/1996 | Headley | 149/35 |
| 6,132,537 | A * | 10/2000 | Zeuner et al. | 149/45 |
| 6,328,830 | B1 | 12/2001 | Wood et al. | |
| 2004/0173922 | A1 | 9/2004 | Barnes et al. | |
| 2005/0067077 | A1 | 3/2005 | Chounet et al. | |

FOREIGN PATENT DOCUMENTS

| | | |
|---|---|---|
| DE | 24 57 748 | 6/1976 |
| DE | 102 30 402 | 1/2004 |
| WO | WO 92/13633 | 8/1992 |
| WO | WO 98/17385 | 4/1998 |
| WO | WO 01/26602 | 4/2001 |
| WO | WO 2004/024653 | 3/2004 |
| WO | WO 2005/005343 | 1/2005 |

OTHER PUBLICATIONS

International Search Report and Written Opinion for International application No. PCT/FR2006/050606 dated Apr. 25, 2007.

* cited by examiner

*Primary Examiner* — Aileen B Felton

(74) *Attorney, Agent, or Firm* — Hamre, Schumann, Mueller & Larson, P.C.

(57) ABSTRACT

The present invention relates to a dry process for the manufacture of pyrotechnic objects from at least one reducing charge selected from guanidine derivatives, metal hydrides, alkali metal hydrides and alkaline earth metal hydrides, and at least one oxidizing charge selected from alkali metal nitrates, alkaline earth metal nitrates and basic metal nitrates, at least one of said reducing and oxidizing charges having the property of flowing under stress. Said process makes it possible to obtain pellets and small tablets directly by compaction/compression, to obtain granules, usable as such, by compaction and then granulation, and to obtain compressed objects by compaction, granulation and then compression.

The high-performance pyrotechnic objects obtained constitute a further subject of the invention.

13 Claims, 2 Drawing Sheets

MANUFACTURE OF PYROTECHNIC OBJECTS BY A DRY PROCESS; PYROTECHNIC OBJECTS

The invention relates to the technical field of pyrotechnic objects, especially those intended for use in the field of motor vehicle safety, e.g. in gas generators for airbags. The invention relates more particularly to a dry process for the manufacture of pyrotechnic objects, especially those intended for use in the field of motor vehicle safety. It further relates to said objects, which are novel per se, and to their uses.

Processes for the manufacture of pyrotechnic objects, comprising a kneading step, an extrusion step carried out with the aid of a twin-screw extruder, and a step for chopping the rod obtained after extrusion, are known in the prior art. This type of manufacturing process is described e.g. in French patent application No. 2 779 426. However, such a process cannot be used for all types of pyrotechnic composition. In fact, when the composition contains a large amount of charges such as ammonium perchlorate or sodium nitrate, the material becomes very viscous and can no longer be extruded.

The novel propellants used for motor vehicle safety can have a charge content in excess of 95% and it is then necessary to employ a different manufacturing process. This manufacturing process is e.g. compression with the aid of a press or a pelletizer.

The production of pellets is based on the following steps:
mixing of the raw materials of the composition, and
compaction.

These two steps can optionally be followed by a granulation step, which can itself optionally be followed by a step for shaping the compressed objects.

U.S. Pat. No. 6,143,102 describes a pyrotechnic composition which can be used in the form of pellets. Such a composition contains guanidine nitrate, basic copper nitrate and one or more metal oxides. It is obtained by a wet process.

The granulation step makes it possible to obtain granules. It is necessary to form granules in order to obtain an appropriate flow of the material towards the pelletizer located downstream, and thus to enable it to function properly.

The granulation can be effected by different methods, e.g. by the slurry method. The slurry method consists in dissolving the charges in a solvent, e.g. water, and then evaporating the solvent. Evaporation of the solvent can be effected e.g. by atomization. Atomization consists in spraying the solution as fine droplets into a stream of hot air, thereby crystallizing the material to form granules. This known type of manufacturing process has the disadvantage of being fairly expensive and of having a low productivity. In known manner, the granules obtained are then compressed in a pelletizer to form pellets of pyrotechnic compounds.

Other known granulation methods can be employed. However, the majority of them require a drying step, which can prove lengthy and difficult. The presence of this step has an adverse influence on the productivity and also gives rise to a high investment cost.

U.S. Pat. No. 5,489,349 describes novel pyrotechnic objects and the process for their production. In a first stage of said process, small fragments are generated from powders by compaction. Said small fragments are then agglomerated by compression under low pressure. They retain their individuality in the structure of the final product.

The object of the invention is therefore to propose a simple process for the manufacture of pyrotechnic objects which has a very satisfactory productivity and a low investment cost.

This object is achieved by combining a technology (the dry process) with the selection of raw materials.

Combining (matching) said technology with specific raw materials makes it possible, under advantageous conditions, to obtain pyrotechnic objects which have excellent properties, especially with reference to use in pyrotechnic gas generators for motor vehicle safety, in the following different forms:

compacted objects, of the pellet or small tablet type, directly produced by a compaction/compression step;

granules produced by two successive steps of compaction and granulation; or compressed objects produced by three successive steps of compaction, granulation and compression.

The process of the invention is particularly suitable for compositions with a high charge content (in excess of 95%, or even (quasi) 100%), at least one of the charges flowing under stress. This is the case e.g. of compositions containing guanidine nitrate.

The process of the invention is a dry process for the manufacture of pyrotechnic objects, comprising:

dry mixing of pulverulent raw materials of the type consisting of oxidizing and reducing charges; and dry compaction of the mixture obtained.

The pulverulent raw materials in question comprise at least one reducing charge selected from guanidine derivatives (such as guanidine nitrate: GN), metal hydrides (such as $TiH_2$), alkali metal hydrides (such as LiH) and alkaline earth metal hydrides (such as $CaH_2$), and at least one oxidizing charge selected from alkali metal nitrates (such as K, Na and Li nitrates), alkaline earth metal nitrates (such as Sr, Be and Ba nitrates) and basic metal nitrates (such as basic copper nitrate: BCN), at least one of said reducing and oxidizing charges having the property of flowing under stress.

The pulverulent raw materials in question preferably comprise at least one guanidine derivative, guanidine nitrate being particularly preferred.

Advantageously, said pulverulent raw materials comprise guanidine nitrate (GN) and basic copper nitrate (BCN). Within the framework of this advantageous variant, they generally comprise:

45 to 55% by weight of guanidine nitrate; and 40 to 50% by weight of basic copper nitrate.

Very advantageously, said raw materials do not contain oxidizing or reducing charges other than said guanidine nitrate (GN) and basic copper nitrate (BCN).

In the process of the invention, the mixing of the pulverulent raw materials is carried out by any technique appropriate to the mixing of such materials (powders).

Compaction is generally carried out by passing the mixture of raw materials between two rolls rotating in opposite directions. A roll compactor is therefore generally used. The compaction pressures are generally between 1500 and 6000 bar.

The mixture of raw materials obtained after the mixing step can be transferred to the compaction step by a single-screw or multi-screw system.

In a first variant, the process of the invention includes a (single) step for simultaneous dry compaction and compression to give (directly) pellets or small tablets with a volume of between 10 $mm^3$ and 2 $cm^3$.

This single compaction/compression step can be carried out in a roll compactor, the outer surface of at least one roll being hollowed out with cells of appropriate dimensions. The mixture of raw materials is compressed in said cells. Advantageously, the roll compactor has (corresponding) cells on the surface of each of its two rolls.

This variant of the process of the invention (which can be summarized as follows: dry mixing+dry compaction/compression) is particularly advantageous in that it enables pyrotechnic objects of the pellet or small tablet type, usable in gas generators, to be obtained directly. It is thus possible to dispense with a subsequent pelletizing step, thereby increasing the productivity and reducing the production costs.

With the selected raw materials, it is thus possible directly to prepare pellets and small tablets of a certain volume which can be used as such.

Pellet and small tablets volumes of between 10 $mm^3$ and 2 $cm^3$ have been indicated. This generally corresponds to pellets and small tablets weighing between a few tens of milligrams and 10 grams.

Such pellets and small tablets are appreciably larger than the fragments according to U.S. Pat. No. 5,489,349.

Such pellets and small tablets and their uses constitute further subjects of the present invention:

- pyrotechnic objects obtainable by the first variant of the process, as described above; pellet-type or small tablet-type objects having the volume and composition as specified above;
- uses of such objects, especially as pyrotechnic charges in a gas generator capable of inflating airbags for motor vehicle safety.

In a second variant, the process of the invention comprises a "conventional" dry compaction that generates a ribbon of compacted material. The surface of the rolls of the compactor used is not machined and is perfectly plane.

It is pointed out here that the compaction pressure is generally between 1500 and 6000 bar, whatever the exact variant of said compaction: compaction/compression or "conventional" compaction.

The ribbon of compacted material obtained after a "conventional" dry compaction is not generally of value as such, but is used to feed a granulator.

Within the framework of its second variant, the process of the invention therefore generally also comprises a dry granulation of the compacted mixture, so it is summarized as follows: dry mixing+dry compaction+dry granulation.

The dry granulation is generally carried out by forcing the compacted mixture through a graded grid, generally with the aid of a rotor that causes said compacted mixture to fragment against said grid. The dry granulation is therefore generally carried out with the aid of one or more granulators each consisting of a rotor and a graded grid.

Within the framework of the implementation of this second variant of the process of the invention, the granulation can advantageously be completed by sorting the resulting granules to give perfectly graded granules. The rejected granules or ungraded residues of material are advantageously reused (recycled into the process) so as to undergo another granulation step.

After this granulation step, pyrotechnic objects are again obtained—this time of the granule type, advantageously graded granules—which can be used directly in pyrotechnic systems such as gas generators. These granules generally have dimensions in the order of a few hundred microns to a few millimeters; their dimensions generally remain below 5 mm.

Such granules can be obtained in particular very dense, from the raw materials identified above, i.e. having a density greater than 90% of the theoretical density.

Such granules and their uses constitute further subjects of the present invention:

- pyrotechnic objects obtainable by the second variant of the process of the invention, completed by a dry granulation as described above; granule-type objects having the density and composition as specified above;
- uses of such objects, especially as ignition charges for pyrotechnic charges included in motor vehicle safety systems or as pyrotechnic charges of this type (same use as that recommended above for the pellets and small tablets directly obtained by compaction/compression).

In a totally novel manner, the process of the invention makes it possible to prepare such granules that can be used directly.

Within the framework of its second variant, the process of the invention can comprise, following the granulation step, a step for dry compression of the granules obtained, so it is summarized as follows: dry mixing+dry compaction+dry granulation+dry compression.

In another variant of the process of the invention, the granules obtained can therefore be used to feed a press.

The pressure applied to the granules is generally between 1500 and 6500 bar to obtain dense objects with a thickness of about 2 mm. This pressure applied on compression is generally greater than the pressure applied on compaction.

The compression carried out on the granules of the invention affords dense compressed pyrotechnic objects (having a density greater than 90% of the theoretical density), especially of the pellet type (in which case the compression step is carried out in a pelletizer), wafer type or monolith type. This is not an exhaustive list.

Such dense compressed pyrotechnic objects and their uses constitute further subjects of the present invention:

- pyrotechnic objects obtainable by the second variant of the process of the invention, completed by a dry granulation and a dry compression, as described above; objects of the compressed type (e.g. pellets, wafers, monoliths, etc.) having the density and composition as specified above;
- uses of such objects, especially as ignition charges for pyrotechnic charges included in motor vehicle safety systems or as pyrotechnic charges of this type (see above).

Those skilled in the art will have grasped the overall value of the process of the invention.

The selected technology (dry process) makes it possible in particular, starting from the selected raw materials (especially GN+BCN):

+ to obtain high-performance pellets and small tablets directly;
+ to obtain granules that can be used directly.

The invention, with its characteristics and advantages, will become more clearly apparent from the following description referring to the attached drawings, in which.

Figure 1:
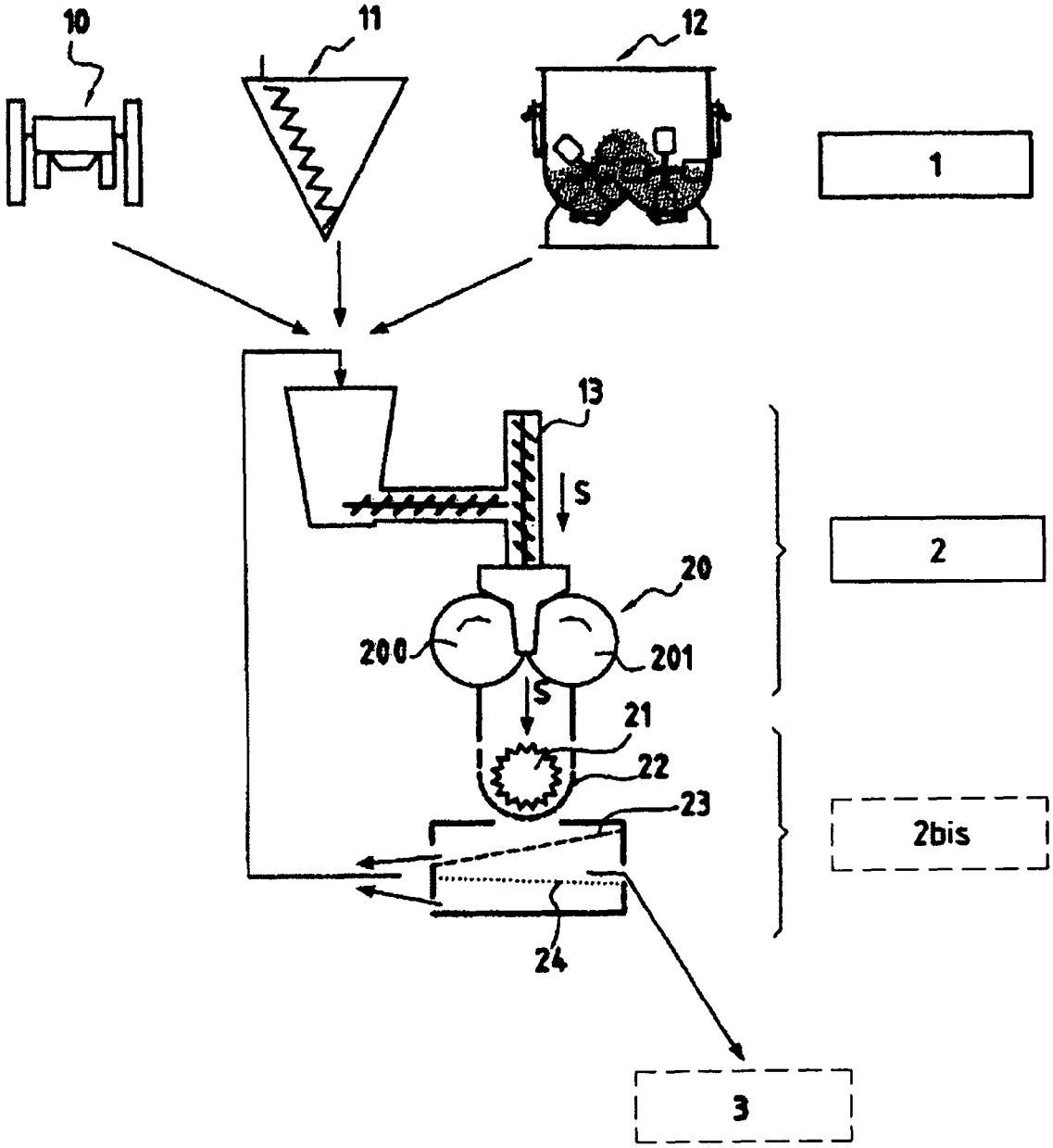
FIG. 1 is a schematic view of one mode of carrying out the manufacturing process according to the invention.

The manufacturing process according to the invention comprises a step 1 for mixing the raw materials forming the composition. As shown in FIG. 1, the mixing can be effected by using different apparatuses known in the state of the art. The mixing can be effected with the aid of a "turner" 10, a convective screw mixer 11 or, for example, a convective paddle mixer 12. According to the invention, the constituents are mixed dry.

The mixture obtained is then subjected to a compaction step 2 and optionally a granulation step **2*bis*. According to the invention, this granulation step is carried out by a dry process, i.e. it does not require the use of a solvent. The mixture in powder form is first injected into a compactor 20 in order to undergo a compaction step. Injection of the material in the forward direction (S) is effected e.g. by using a screw system 13 opening into the compactor 20. The compactor 20 takes the form of two rolls (200, 201) arranged in parallel and spaced so as to leave a gap between them, where the mixture is compacted. The two rolls (200, 201) are rotated about their respective axes in opposite directions and at identical speeds. A pressure is applied to the material between the rolls. The direction of rotation of the rolls (200, 201) is chosen so as to move the material in the forward direction (S) defined by the endless screw 13**.

The compacted mixture leaving the compactor 20 takes the form of e.g. ribbons or, if there is compression, pellets or small tablets.

If there is no compression, the ribbons emerging from the compactor can then be introduced into the granulator. Conversion to granules is effected e.g. by using a rotor 21 rotating in the vicinity of a grid 22. As it rotates, the wheel 21 makes it possible to force the ribbon of material through a grid 22. As it passes through the orifices in the grid 22, the ribbon is thus ground to granules.

The granules obtained are then sorted so that they are of a particular grade. To obtain the granules of the desired size, it is possible to use a system of two superimposed grids (23, 24). The upper grid 23 has a greater mesh length than the lower grid 24. If the granules obtained are of the desired size, they pass through the upper grid 23, while the excessively large granules remain on this grid 23. The excessively small granules pass through the upper grid 23 and through the lower grid 24. The granules situated between the two grids (23, 24), i.e. those which are neither too small nor too large, will either be used for the manufacture of compressed objects such as pellets, wafers or monoliths (said granules are compressed for this purpose), or used directly as such. The excessively large and excessively small granules can be reinjected into the compacter 20.

Figure 2:
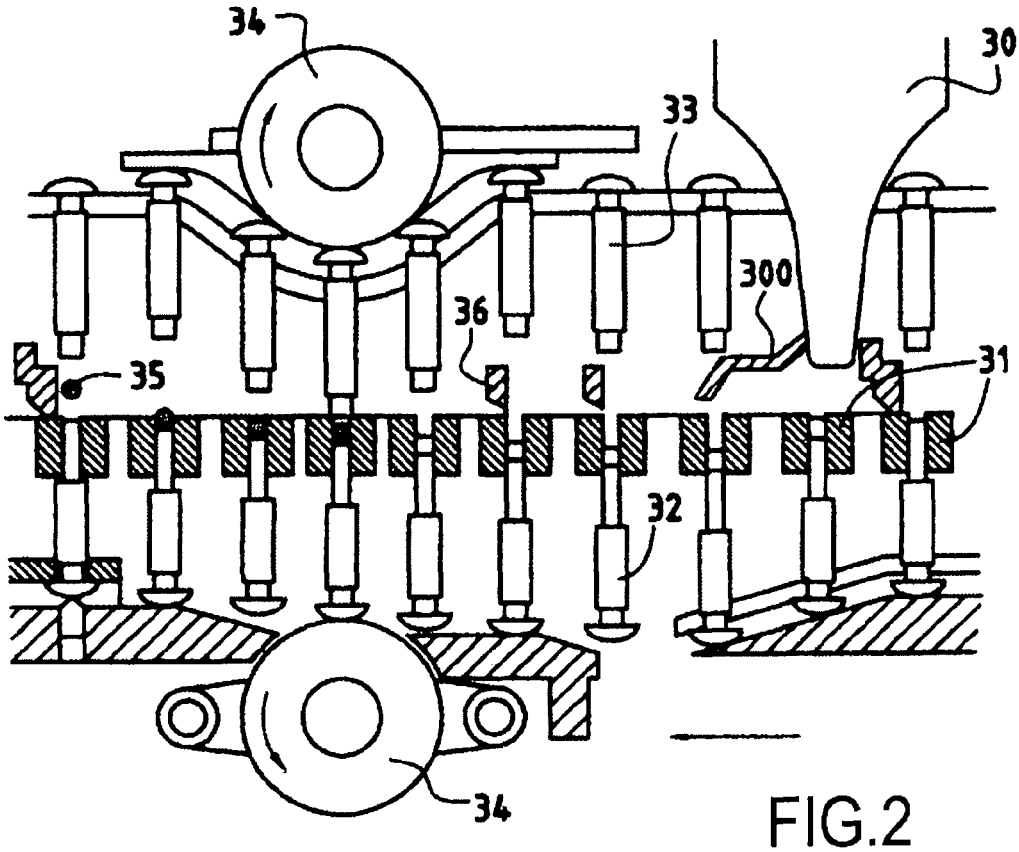
FIG. 2 is a top view of the cycle of a rotary pelletizer capable of being used in carrying out one variant of the process according to the invention.

The conversion of the pyrotechnic composition to pellets (pelleting step 3) can be effected with the aid of a rotary pelletizer, whose operating principle is shown in FIG. 2, or e.g. with the aid of a reciprocating press (not shown).

The granules are poured continuously into a hopper comprising a feeder 300, and many dies 31, carried by a turret, travel continuously in front of said feeder. Two punches (32, 33), one lower and one upper, are associated with each die 31. The lower punch makes it possible to meter the granules poured into the die 31 with the aid of the feeder 300. A leveling device 36 then makes it possible to remove the excess granules from the die 31. As the die 31 filled with granules rotates, the lower punch 32 and the upper punch 33 move towards one another, e.g. with the help of pressure rollers 34, until they compress the granules located between them. The pyrotechnic compound 35 formed by compression between the two punches is then ejected.

In one variant of the process according to the invention, the compression step can be omitted, it being possible for the production of dense graded granules to be sufficient for feeding a pyrotechnic system.

Figure 3:
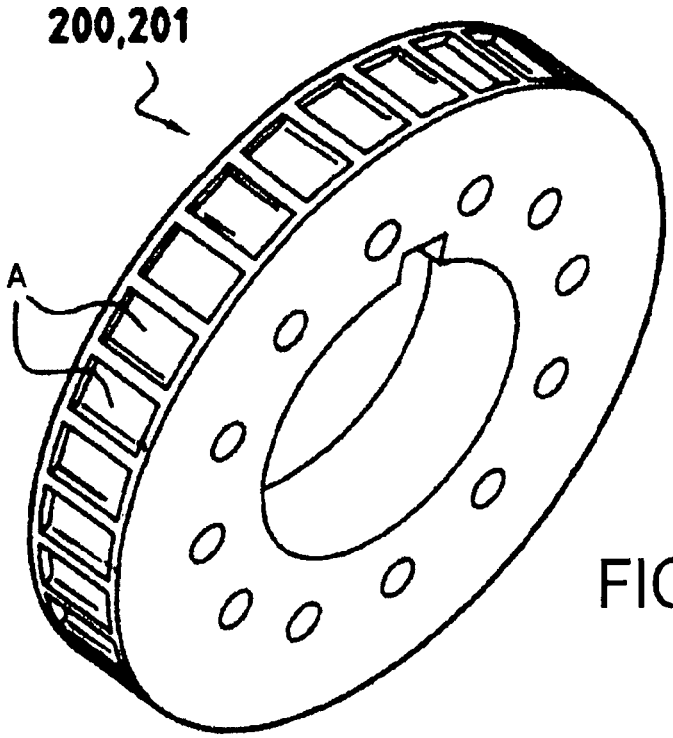
FIG. 3 shows an example of a compaction roll containing cells for obtaining compacted/compressed objects directly.

In one variant of the process according to the invention, the step for conversion to granules by forced passage through the grid 22, and the compression step, can be omitted, in which case the compression to pellets or small tablets takes place during the compaction. To do this, in the variant shown, the edge of each of the compaction rolls (200, 201) has cells (A, FIG. 3). The cells A can have different geometric shapes, e.g. with an oblong, square or circular cross-section. During rotation, each cell A of each of the rolls (200, 201) is associated with and corresponds to a cell in the other roll. In this variant, the mixture of pyrotechnic material is therefore not only compacted between the rolls (200, 201), but also compressed directly to pellets or small tablets in the cells A. Omission of the (subsequent) compression step therefore makes it possible to increase the production rate and substantially reduce the production cost.

The invention claimed is:

1. A dry process for the manufacture of pyrotechnic objects, comprising:

dry mixing of pulverulent raw materials that include oxidizing charges and reducing charges;

dry compaction of the mixture obtained; and dry granulation of the compacted mixture, wherein said pulverulent raw materials comprise at least one reducing charge selected from guanidine derivatives, metal hydrides, alkali metal hydrides and alkaline earth metal hydrides, and at least one oxidizing charge selected from alkali metal nitrates, alkaline earth metal nitrates and basic metal nitrates, at least one of said reducing and oxidizing charges having the property of flowing under stress, and said dry compaction is carried out in a roll compactor and generates a ribbon of compacted material.

2. The process according to claim 1, wherein said pulverulent raw materials comprise guanidine nitrate.

3. The process according to claim 1, wherein said pulverulent raw materials comprise:

45 to 55% by weight of guanidine nitrate; and 40 to 50% by weight of basic copper nitrate.

4. The process according to claim 1, wherein a pressure for the dry compaction is between 1500 and 6000 bar.

5. The process according to claim 1, wherein said dry granulation is carried out by forcing the compacted mixture through a graded grid.

6. The process according to claim 1, further comprising a dry compression of the granules obtained by the dry granulation.

7. Pyrotechnic objects obtainable by the process according to claim 1 and taking the form of granules having a density greater than 90% of the theoretical density.

8. The process according to claim 3, further comprising a dry compression of the granules obtained by the dry granulation.

9. An ignition charge for a pyrotechnic charge included in a motor vehicle safety system, comprising a pyrotechnic object according to claim 7.

10. A pyrotechnic charge included in a motor vehicle safety system, comprising a pyrotechnic object according to claim 7.

11. Pyrotechnic objects obtainable by the process according to claim 8 and taking the form of compressed objects having a density greater than 90% of the theoretical density.

12. The process according to claim 1, wherein said pulverulent raw materials contain more than 95% wt. % of said oxidizing charges and said reducing charges.

13. The process according to claim 1, wherein said pulverulent raw materials consist of said oxidizing charges and said reducing charges.

* * * * *